United States Patent [19]

Owens et al.

[11] 4,250,877

[45] Feb. 17, 1981

[54] DIVER'S HELMET AND FACE MASK FOR USE THEREWITH

[75] Inventors: Jack H. Owens, North Reading; John E. Slavin, Acton, both of Mass.

[73] Assignee: Morse Diving Equipment Company, Inc., Rockland, Mass.

[21] Appl. No.: 906,084

[22] Filed: May 15, 1978

[51] Int. Cl.[3] ..... A42B 3/00; A62B 18/04

[52] U.S. Cl. ..... 128/207.11; 128/201.23; 128/205.25; 128/203.29

[58] Field of Search ..... 2/181, 9; 128/142.7, 128/141 R, 141 A, 142.6, 142.5, 142.4, 142.3, 142.2, 142, 195, 205, 145, 206.14, 206.21, 206.24, 206.25, 206.27, 206.28, 207.11, 207.13, 203.29, 201.23, 201.24, 205.25

[56] References Cited

U.S. PATENT DOCUMENTS

| | | | |
|---|---|---|---|
| 1,686,592 | 10/1928 | Wood | 128/195 |
| 2,229,706 | 1/1941 | Schneider | 128/142.4 |
| 2,444,417 | 7/1948 | Bierman | 128/141 A |
| 3,438,060 | 4/1969 | Lobelle et al. | 128/142.7 X |
| 3,521,630 | 7/1970 | Westberg et al. | 128/146.6 |
| 4,038,979 | 8/1977 | McCosker | 128/141 R |

FOREIGN PATENT DOCUMENTS

| | | | |
|---|---|---|---|
| 1378213 | 10/1954 | France | 128/205 |
| 1514504 | 1/1968 | France | 128/141 R |

*Primary Examiner*—Harry N. Haroian

[57] ABSTRACT

An oral-nasal device includes a face mask and mask-securing means. The mask has a first portion formed with a cavity to accommodate the nose of the wearer and overlie his mouth, a second portion that is a compliant seal surrounding the cavity, and a shoulder surrounding the cavity and overlying the seal. The mask-securing means includes a pressure plate which in use forces the seal to conform to the facial features of the wearer and to be continuously sealed thereto. In the disclosed embodiment of the invention, the mask-securing means is secured to a diver's helmet.

17 Claims, 8 Drawing Figures

33
47
32
20
30
34'
35
10
27
24
7
7
29
23
25
31D
31E
28
26
47
39
45
36
31C
31
33

10
48
49
50
47

31E
31
20
31D
31C
31F
31F
33
33
36
47
20
34
43
44
41
41
37
30
35
38

DIVER'S HELMET AND FACE MASK FOR USE THEREWITH

BACKGROUND OF THE INVENTION

Diving equipment has undergone rapid development enabling divers to descend to ever increasing depths. As the capability to do so grows, so does the demand for means to ensure the safety of the divers to the maximum extent.

One area of particular concern is the sealing of the face masks to the face. While the sealing of the masks is an obvious requirement, problems in the way of meeting that requirement are that facial features vary greatly while the seal must be subjected to adequate sealing pressure all the way about the mask cavity which accommodates the nose and overlies the mouth and the cavity must usually be of minimum volume to minimize its contribution to respiratory dead space. Where the gas within the helmet may contain a dangerous percentage of carbon dioxide, the effectiveness of the mask seal is particularly important.

THE PRESENT INVENTION

The general objective of the present invention is to provide oral-nasal devices ensuring effective sealing of the face mask to the face of the user.

In accordance with the invention, this objective is attained with an oral-nasal device that includes a face mask and mask-securing means.

The face mask includes a first portion having a cavity dimensioned to accommodate the nose of the wearer and overlie his mouth, a second portion that is a seal of compressible material continuously surrounding the cavity, and an exposed shoulder continuously surrounding the cavity and overlying the seal. The seal is shaped and dimensioned to correspond, when compressed, generally to facial features bordering the nose and mouth and when subjected to pressure applied to the shoulder with the mask in place the seal conforms to the facial features of the wearer.

The mask-securing means include a pressure plate dimensioned to engage the shoulder of the mask and means to hold the pressure plate under sealing pressure when the face mask is in place. Preferably the face mask and the securing means are separable. When the oral-nasal device is to be used in a helmet, the helmet includes means to hold the user's head in a predetermined position and the mask-securing means are preferably a permanent part of the helmet.

Among the features of such a face mask and the securing means therefor is that the width of the seal is maximum and the seal is compliant to adjust readily under pressure to variations in facial features. In addition, the cavity provides a clearance between the nose and mouth that establishes a minimum respiratory air space, a feature that where it is wanted, more than offsets the necessity of the requirement of a sufficient range of masks, each varying only as to dimensions of the seal.

Factors determining the volumetric capacity of the dead air space in the face mask are largely dependent on the use for which the oral-nasal device is intended. When the face mask has the simplest provisions for controlling the inhaling and exhaling of the breathing gas, the air space may be substantially less than where, for example, a microphone is included and the inhaling and exhaling of the gas is subject to alternate controls.

Other objectives of the invention will be apparent from the following description of a preferred embodiment and the appended claims.

BRIEF DESCRIPTION OF THE DRAWINGS

The accompanying drawings illustrate a preferred embodiment of the invention of which

THE PREFERRED EMBODIMENT OF THE INVENTION

Figure 1:
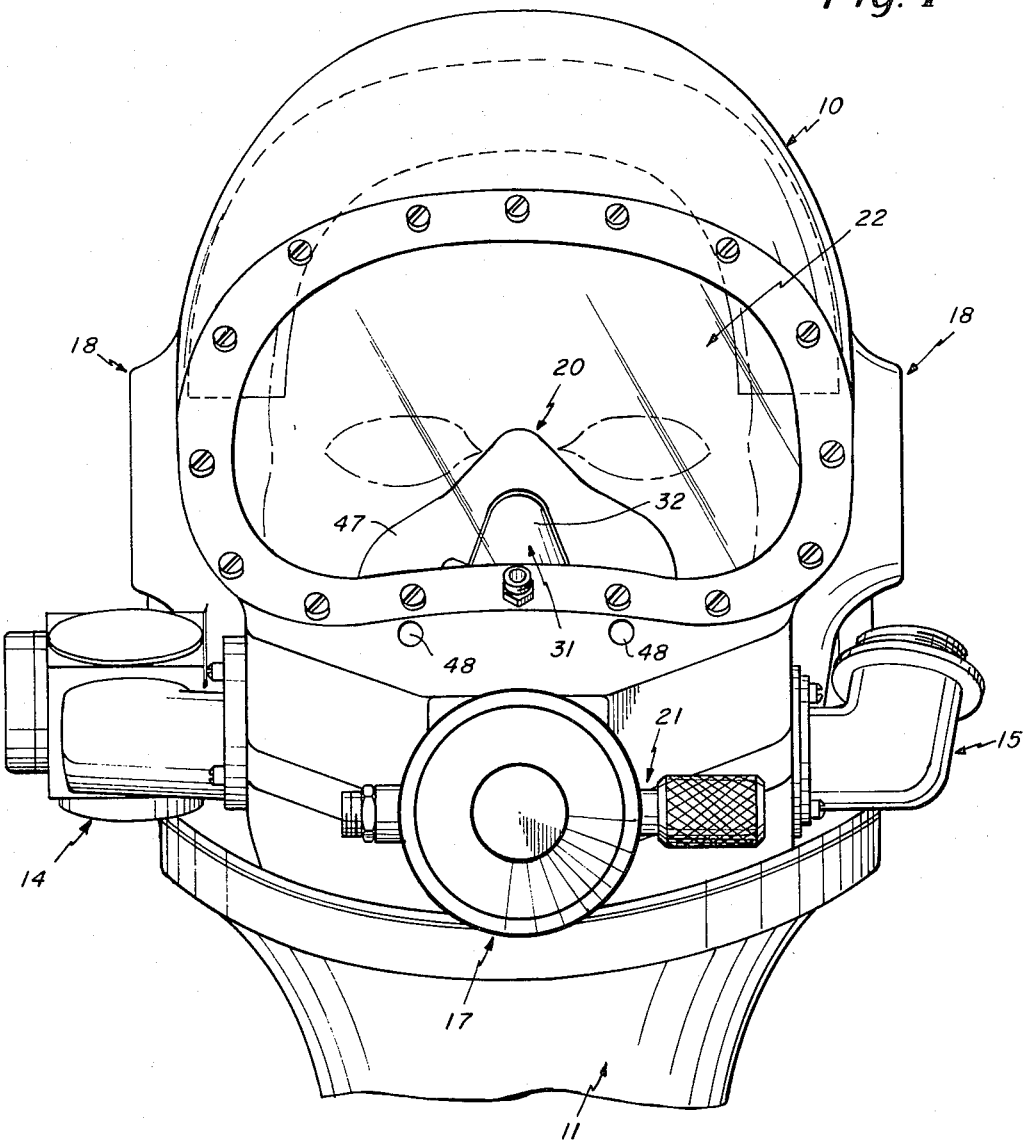
FIG. 1 is a front view of a diver's helmet and a face mask in accordance with the invention showing the relation of the mask to a diver's face.
Figure 2:
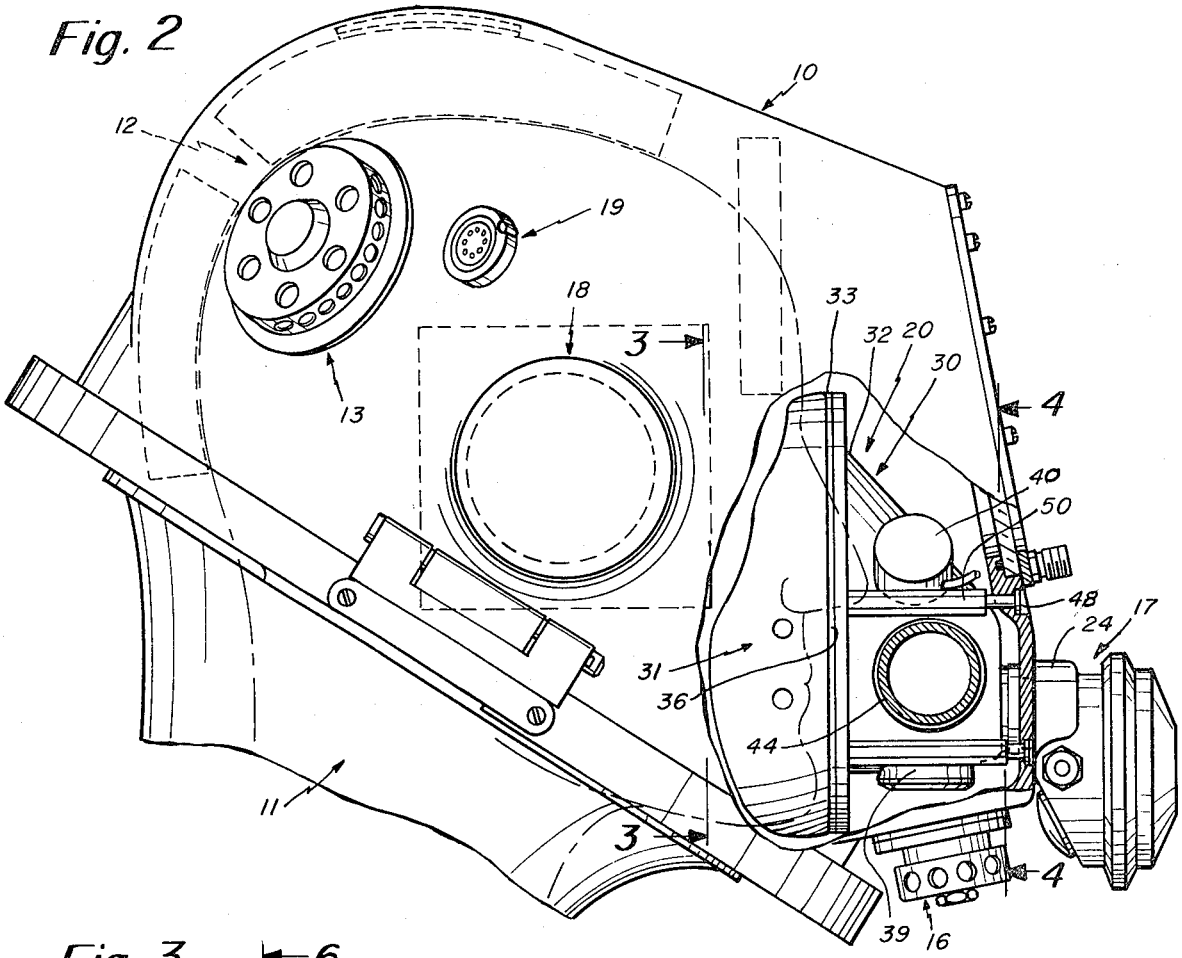
FIG. 2 is a side view of the helmet broken away to show the oral-nasal device and its relation to the diver's face.
Figure 3:
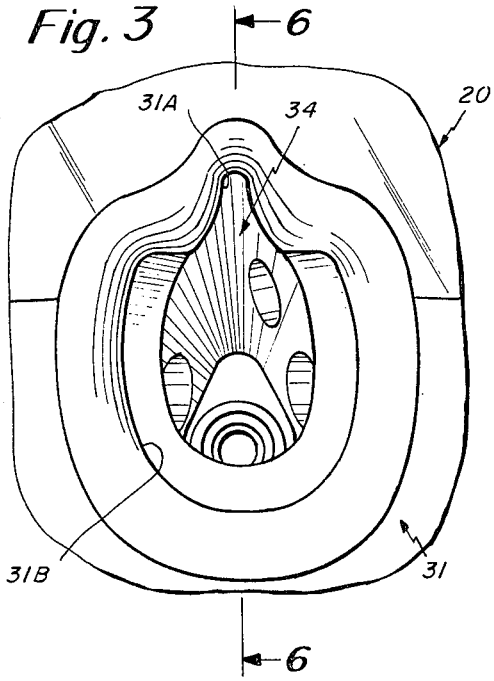
FIG. 3 is a section taken approximately along the indicated line 3—3 of FIG. 2 to show the rear or inside of the face mask.
Figure 4:
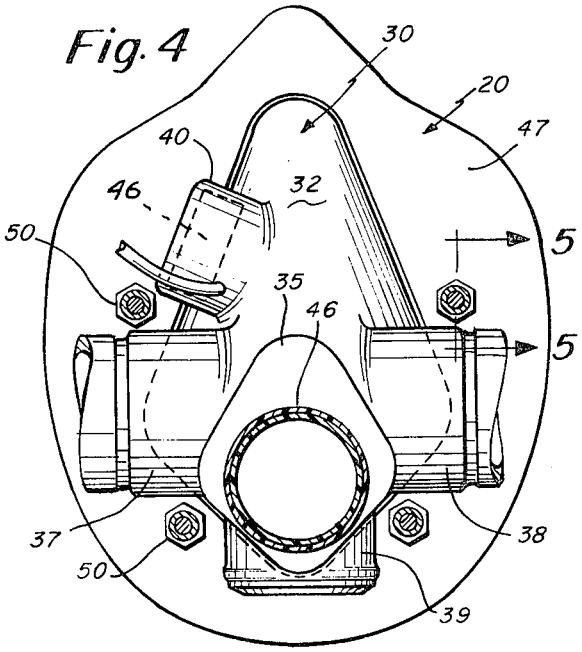
FIG. 4 is a section taken approximately along the indicated line 4—4 of FIG. 2 to show the front or outside of the mask.
Figure 8:
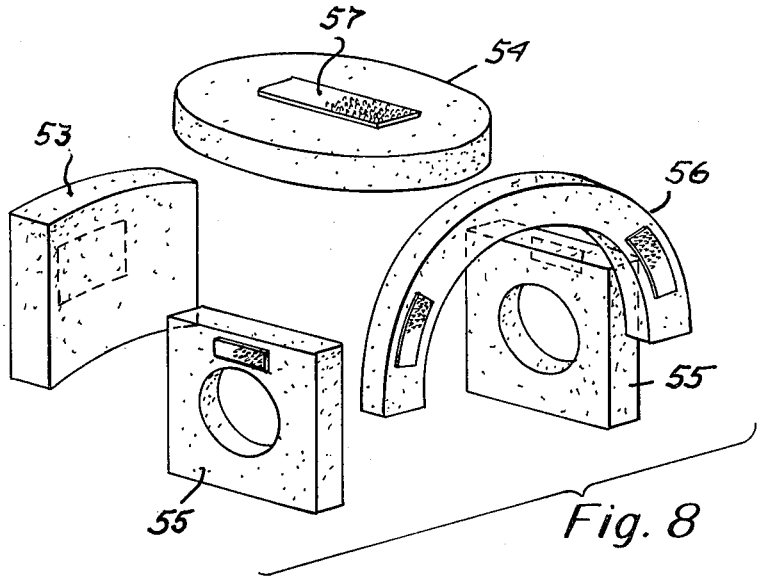
FIG. 8 is a somewhat schematic view of the head cushioning means.

A diver's dry helmet is generally indicated at 10 and includes a neck dam 11 and internal, head-cushioning means generally indicated at 12 in FIGS. 1 and 2 and detailed schematically in FIG. 8. The helmet 10 is provided with an over pressure relief valve assembly 13, a supply assembly 14 for the breathing gas provided with a one way valve, a gas return assembly 15 provided with a one way valve, a manually operated water purge valve assembly 16, and a demand regulator assembly 17. Earphone assemblies and an electrical connection assembly are generally indicated at 18 and 19, respectively. As these assemblies are conventional and as they form no part of the present invention, they are not detailed.

It should be here noted that in the embodiment of the invention being described, provision is made for two modes of operation. In normal operation, breathing gas is delivered to a pack, not shown, carried on the back of the diver through which the gas may be circulated into the face mask, generally indicated at 20, via the supply assembly 14 and from the face mask 20 back to the pack via the return assembly 15 where the gas is processed to maintain its carbon dioxide content at an appropriate low level. In the alternate mode of operation, gas is delivered directly to the demand regulator assembly 17 through a valve controlled line, not shown, under the control of the manually operated adjusting valve 21.

Other helmets in accordance with the invention may not include all of such assemblies and may include other means than those of the helmet 10, to control the admission of breathing gas into the face mask 20 and the exhaust therefrom of exhaled gas.

Figure 6:
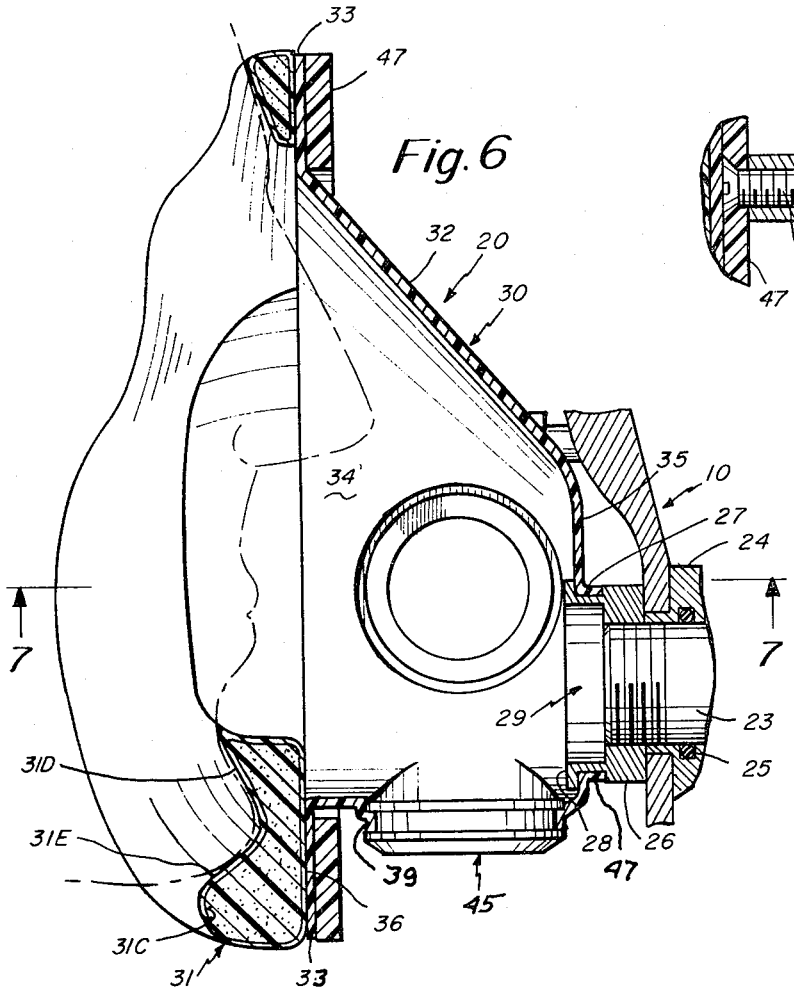
FIG. 6 is a section taken generally along the line 6—6 of FIG. 3.
Figure 5:
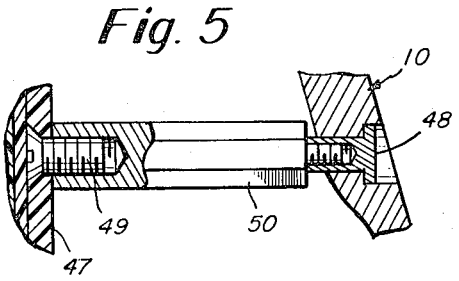
FIG. 5 is a section, on an increase in scale taken approximately along the indicated line 5—5 of FIG. 4.

The demand regulator assembly 17 located below the lens 22 has, see FIGS. 2 and 6, an inlet tube 23 extending into the helmet 10 through a mount 24 provided with an O-ring seal 25 for the tube 23 and permanently sealed to the outer surface of the helmet 10. An adapter 26, threaded on the inner end of the tube 23, has an annular channel 27 the rear wall of which provides an anchoring flange 28. The adaptor 26 is provided with a one way valve 29, an intake valve in the disclosed embodiment.

Turning now to the face mask 20, it will be seen that the face mask consists of a thin-walled molded cavity portion 30 and a molded face seal portion 31. The cavity portion 30 has a central part 32 and a marginal, plane flange 33. The central part 32 has a cavity 34 that is approximately tear drop in shape and dimensioned to accommodate the nose and overlie the mouth of the diver with minimum clearances thus to minimize respiratory dead space. The wall structure of the central part 32 is inclined forwardly and inwardly and joins a flat front wall 35 which is parallel to the flange 33.

The face seal portion 31 has an outer plane face 36 shaped and dimensioned to enable it and the flange 33 of the cavity portion to be bonded together by a suitable adhesive to complete the face mask. The size, shape and dimensions of the face seal portion 31 are such that a face sealing zone is established that generally follows the bone structure of the face. The sealing zone may best be described with reference to the vertical center line of the assembled mask which coincides with that of the nose and with reference to which center line both sides of the sealing portion 31 are symmetrical. The upper end 31A of the sealing zone is in the form of a relatively narrow inverted U in order that the area of the bridge of the nose and the sides of the nose may be sealed without interference with the diver's vision. Below the upper portion, the face seal extends laterally to lie against the cheek bones and then curves downwardly with its lower end 31B in the form of a relatively wide U, the bottom of which is engageable with the chin. As may best be seen in FIGS. 2 and 6 the depth of the face seal portion 31 varies from a minimum in the upper and lower ends to a maximum in the zones between the cheek and jaw bones, substantially at their junction.

Figure 7:
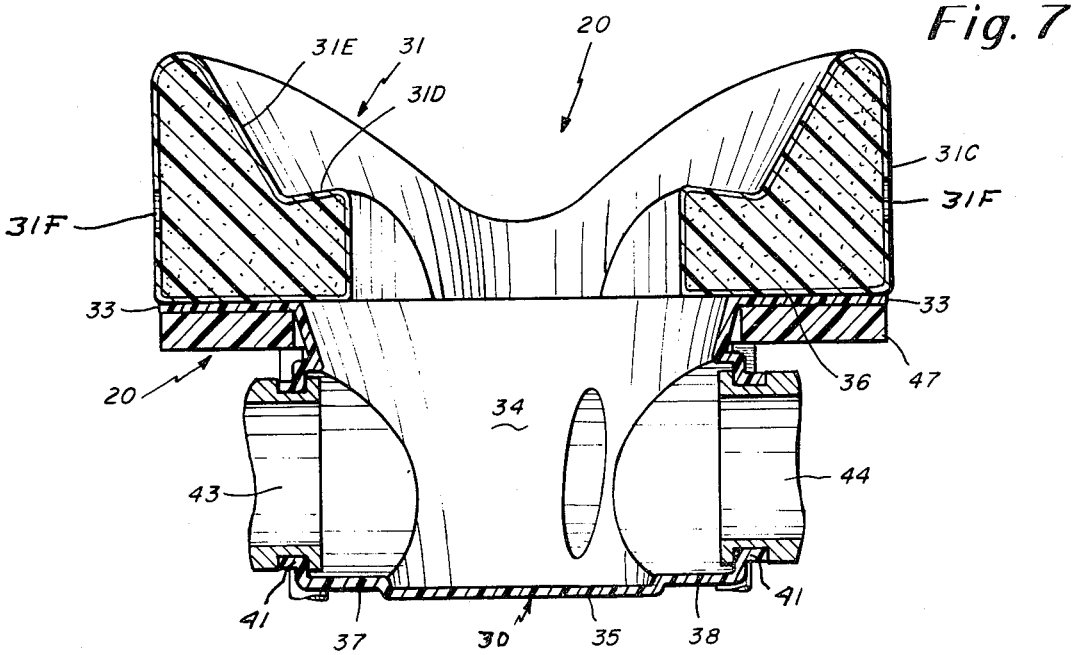
FIG. 7 is a section taken approximately along the indicated line 7—7 of FIG. 6.

The face seal portion 31 is a soft body of such material as sponge rubber and a smooth compliant impervious skin 31C and below the upper end 31A is formed with an inner shoulder 31D and an outwardly tapered outer wall 31E which at its lower end, underlies the chin, see FIG. 6. It will be noted, see FIG. 7, that the outer skin 31C is perforated to provide vents 31F to enable changes in ambient pressures to be compensated.

Before detailing the means by which the face mask 20 is safely secured, certain details of the cavity portion 30 should be noted, see FIGS. 2, 3, 4, 6, and 7. In the lower part of the central part 32 there are oppositely opening hollow side bosses 37 and 38, a downwardly opening hollow boss 39, and at one side of the central part 32 and above the boss 37, there is a hollow boss 40. All of the bosses, except the boss 40, include a front wall 41 having a centrally located port 42. With such bosses, a member having a flanged end (desirably the end wall of a groove) may be attached to the mask portion 30 with the boss front wall 41 forced over such an end flange. Such a member may be, in the case of the bosses 37 and 38 the ends, respectively, of the gas supply and gas return conduits 43 and 44, in the case of the boss 39, the pressure equalizing valve 45 with the breathing gas discharged into the helmet 10 resulting in a build-up therein of a dangerous percentage of carbon dioxide. The boss 40 has the microphone assembly lodged therein. The front wall 35 has a port 47 for the adapter 26 with the front wall caught over the flanged end thereof.

The oral-nasal device includes, as a separate part in the detailed embodiment of the invention, mask securing means, see FIGS. 1, 5, 6, and 7, shown as secured to the helmet 10. The mask securing means has a pressure plate 48 provided with a central opening shaped and dimensioned to receive within it the centarl part 32 of the cavity portion 30 and to seat against its laterally exposed flange 33 with its outer edge then substantially coinciding with the outer edge of the flat face 36 of the face-engaging, seal portion 31. Permanently mounted and sealed in bores in the helmet 10 below the lens 22 are four, blind-threaded inserts 49 extending into the helmet two above and two below the mount 24 and laterally spaced so each of the upper and lower pair of screws is on an opposite side of the central part 32 of the cavity portion, one above and one below the respective one of the bosses 36 and 37.

Screws 50 extend forwardly through the pressure plate 48 and into spacers 51, shown as hexagonal in cross section, which include threaded ends 51A of opposite hand threaded into the inserts 49 thus providing a degree of adjustment of the pressure or backing plate 48 relative to the helmet 10 and flange 33. It should be noted that the head of the diver is backed by the head-cushioning means 12. It will be appreciated that the sealing pressure is applied continuously about the cavity portion and against the face seal by the mask securing means and while, due to the contour of a face, the pressure is not uniform, it is adequate due to the variations in thickness of the seal to establish a perfect seal continuously about the nose and mouth of the device, the sealing pressure such that the seal is maintained effective even though the head-cushioning means 12 are shown as of a resiliently yieldable type.

In FIG. 8 suitable head-cushioning means are shown as including a section 52 for engagement by the back of the head, a section 53 engageable by the top thereof, apertured side sections 54 to overlie the ears, and a U-shaped section 55 to overlie the front of the head and the sides thereof forwardly of the ears. Each section is secured as by a length of Velcro caught by a length of the same material adhesively secured to the interior of the helmet 10, and such length indicated at 56.

We claim:

1. In combination, a helmet provided with means to hold the head of a user in a predetermined position, a face mask consisting of first and second integral portions, the first portion having a cavity dimensioned to accommodate the nose of a user and to overlie his mouth, and the second portion an exposed, planar, marginal shoulder continuously surrounding the open end of the cavity, and a body shaped and dimensioned to conform generally to facial features marginally of the nose and mouth without interfering with a user's vision and provided with a planar outer surface to which said second portion is sealed, said face mask of pliant material and the body of a material sufficiently compressible to comply to the particular facial features of the user to become continuously sealed thereto when pressure is applied against the shoulder continuously about the first portion, a flat rigid plate having an aperture dimensioned to accommodate said first mask portion and shaped and dimensioned to engage said shoulder, and pressure applying means within said helmet and attached to the front thereof and in engagement with said plate on opposite sides of the cavity.

2. The combination of claim 1 in which the head holding means provides a resilient, compressible cushion at least for the back of the head and the pressure applying means provides sufficient pressure to maintain the seal effective throughout the limits to which the cushion is compressed during normal use.

3. The combination of claim 1 in which the helmet has an assembly including a breathing gas conduit secured and sealed to the exterior of and extending into the helmet, the first portion of said face mask has a port alignable with the inner end of the conduit and an adapter threaded on said inner end includes a flange over which the margins of the port are caught.

4. The combination of claim 1 in which the spacing means are adjustable towards and away from the front of the helmet.

5. The combination of claim 1 in which the pressure applying means includes a series of spacing means each including a pair of screws of opposite hand one carried by the helmet and the other by the pressure plate and threaded into opposite ends of the spacer thereby to enable the spacing of the pressure plate relative to the helmet to be varied.

6. The combination of claim 5 in which there are four spacing means, two on each side of the cavity of the mask with one above and one below the portion of the cavity that overlies the mouth of the user.

7. A face mask to be worn within a helmet provided with means to hold the user's head in a predetermined position and with means including an apertured rigid pressure plate backed by the front of the helmet, said mask consisting of first and second integral portions, the first portion having a cavity shaped and dimensioned to accommodate the nose of a user and to overlie his mouth, and the second portion an exposed marginal, planar shoulder continuously surrounding the open end of the cavity, said pressure plate shaped and dimensioned to overlie and continuously engage said shoulder, and a body shaped and dimensioned to conform generally to facial features marginally of the nose and mouth without interferring with a user's vision and provided with a planar outer surface to which said second portion is sealed, said face mask of pliant material and the body of a material sufficiently compressible to comply to the particular facial features of the user and become continuously sealed thereto when said pressure plate is seated against said shoulder with pressure applied to opposite portions thereof.

8. The combination of claim 7 in which the second portion includes a sponge rubber interior and an impermeable skin, said skin having vent ports opening outside the face mask.

9. The face mask of claim 7 in which the body includes an upper part in the form of a narrow inverted U to receive within it and seal the upper part of a nose, a lower part in the form of a relatively wide U shaped and dimensioned to seat against the chin of the wearer and increasing in depth and width to engage and extend along the jaw and upwardly substantially at the junction of the jaw and cheek bones, and connecting parts extending along the cheek portions and joining the upper and lower parts.

10. The face mask of claim 9 in which the lower part includes an inner shoulder and a marginal wall tapering away therefrom.

11. The face mask of claim 9 in which the seal includes a sponge rubber interior and an impermeable skin, said skin having vent ports opening outside the face mask.

12. A helmet for use with a face mask consisting of first and second integral portions, the first portion having a cavity shaped and dimensioned to accommodate the nose of a wearer and to overlie his mouth, and the second portion an exposed marginal, planar shoulder, continuously surrounding the open end of the cavity, and a body shaped and dimensioned to conform generally to facial features marginally of the nose and mouth without interferring with a wearer's vision and provided with a planar outer surface against which said second portion is sealed, said body sufficiently compressible to comply to the particular facial features of the wearer and become continuously sealed thereto when pressure is applied to said shoulder, said helmet including a rigid pressure plate having an aperture dimensioned to enable said plate to be seated against said second portion and a plurality of spacing means connected to the front of the helmet and extending inwardly on opposite sides of the cavity of the face mask, said plate connected to said spacing means and said spacing means of a length such that with the face mask in place and the helmet worn, mask sealing pressure is applied uniformly to said shoulder by the pressure plate.

13. The helmet of claim 12 in which the spacing means includes a series of members extending inwardly from the face of the helmet, a series of connections carried by said pressure plate and having threaded connection with said members.

14. The helmet of claim 12 and an assembly including a breathing gas conduit secured and sealed to the exterior of the helmet and extending into the helmet, and a flanged adapter threaded on the inner end of the conduit to which the first portion of the mask is connectable to place the conduit in communication with the cavity.

15. The helmet of claim 12 in which the spacing means are adjustable to enable the spacing of the pressure plate relative to the helmet to be varied.

16. The helmet of claim 15 in which the spacing means include a series of spacers, screws of opposite hand carried by the helmet and pressure plate and threaded in opposite ends of the spacers.

17. The helmet of claim 16 in which there are four spacing means, two to be on each side of the cavity of the face mask with one above and one below the portion thereof that overlies the mouth.

* * * * *